US006019678A

United States Patent [19]

Takahashi

[11] Patent Number: 6,019,678

[45] Date of Patent: Feb. 1, 2000

[54] VENTILATION FAN FOR DUCT AND METHOD OF INSTALLATION THEREOF

[75] Inventor: Kazuo Takahashi, Kagamihara, Japan

[73] Assignee: Matsushita Seiko Company, Ltd., Osaka, Japan

[21] Appl. No.: 09/034,869

[22] Filed: Mar. 4, 1998

[30] Foreign Application Priority Data

Mar. 6, 1997 [JP] Japan ..... 9-051342

[51] Int. Cl.[7] ..... F24F 7/013

[52] U.S. Cl. ..... 454/354

[58] Field of Search ..... 454/349, 354

[56] References Cited

U.S. PATENT DOCUMENTS

| | | | |
|---|---|---|---|
| 2,134,142 | 10/1938 | Orear | 454/354 |
| 5,879,232 | 3/1999 | Luter, II et al. | 454/354 |

FOREIGN PATENT DOCUMENTS

| | | | |
|---|---|---|---|
| 1.209.862 | 3/1960 | France | 454/354 |
| 58-102041 | 6/1983 | Japan | 454/354 |
| 1-140444 | 9/1989 | Japan . | |
| 5-5544 | 1/1993 | Japan . | |
| 5-106894 | 4/1993 | Japan | 454/354 |
| 5-203214 | 8/1993 | Japan . | |
| 860564 | 2/1961 | United Kingdom | 454/354 |

*Primary Examiner*—Harold Joyce
*Attorney, Agent, or Firm*—Ratner & Prestia

[57] ABSTRACT

A ventilation fan for duct being capable of inserting the ventilation fan smoothly into the opening in the ceiling, and free from strange feel between the design of the decorative plate and pattern of the ceiling.

It includes (a) a ventilation fan main body having a blower including a fan installed inside, an intake port formed at the lower side and a scroll having an exhaust port, and a wind tunnel installed at the intake port side of the blower, and having a curved portion rotatable along the brim of an opening formed in the ceiling, (b) an adapter for duct connection detachably fitted to the exhaust port, and (c) a decorative plate which may be installed by covering the lower surface of the wind tunnel.

Therefore, as the curved portion of the wind tunnel rotates along the brim of the opening, the ventilation fan main body is fitted to the ceiling, and the decorative plate is fitted to the lower side by covering the wind tunnel. Moreover, the ventilation fan main body is connected to the adapter.

20 Claims, 6 Drawing Sheets

VENTILATION FAN FOR DUCT AND METHOD OF INSTALLATION THEREOF

TECHNICAL FIELD OF THE INVENTION

The present invention relates to a ventilation fan for duct inserted and installed in an opening provided in a ceiling for exhausting the indoor foul air, and a method of its installation.

BACKGROUND OF THE INVENTION

Recently, by using the ventilation fan installed in the ceiling, the ventilation fan for duct for exhausting the indoor foul air outdoors through the duct for improving the environment of living space is becoming popular. At the same time, the concern about the indoor interior quality is being heightened year after year. Further, the concern about the work for installing the ventilation fan for duct is also heightened year after year.

A conventional example of ventilation fan for duct is described while referring to FIG. 4 through FIG. 6. As shown in FIG. 4 through FIG. 6, at the back side of a decorative plate 102 provided at the indoor side intake port of a ventilation fan main body 101, a spring 103 for attaching to the ventilation fan main body 101 is provided, and an adapter 105 for connecting to an exhaust duct 104 is fitted to the side of the ventilation fan main body 101. The junction surface of an exhaust port 106 at the side of the ventilation fan main body 101 and the adapter 105 for connecting to the exhaust duct 104 is a flat surface because the shape of the ventilation fan main body 101 is in a box shape. Besides, since the shape of a scroll 107 which is a part of the ventilation fan main body 101 is in a spiral shape, and hence a flat portion 108 is formed outside, but to form the box shape of the ventilation fan main body 101, a wall 109 is provided, and a motor 112 for driving blades 111 is provided in a top plate 110.

When installing such conventional ventilation fan for duct, the exhaust duct 104 is preliminarily installed at the position for installing the ventilation fan for duct, and an opening 114 for inserting the ventilation fan main body 101 is provided in a ceiling 113, and a wood frame 115 for fixing the ventilation fan main body 101 is assembled behind the ceiling of the opening 114. In such state, first the adapter 104 is inserted into the opening 114, and fixed to the exhaust duct 104 by taping or the like, and fixed to the wood frame 115 by screws. Then, while fitting the ventilation fan main body 101 into the adapter 105, it is inserted into the opening 114, and is fixed to the wood frame 115 by screws. Finally the spring 103 of the decorative plate 102 is inserted into a slot 116 provided in the ventilation fan main body 101, and the decorative plate 102 is fitted to the ventilation fan main body 101.

In such conventional ventilation fan for duct, since the shape of the ventilation fan main body 101 and opening 114 is square, the mounting direction of the decorative plate 102 is controlled at 90-degree increments. Hence, there was a strange feel between the design of the decorative plate 102 and the pattern of the ceiling 113. Moreover, the junction surface of the exhaust port 106 at the side of the ventilation fan main body 101 and the adapter 105 for connecting to the exhaust duct 104 is a flat surface, and the flat surface is not stable in shape, and a gap may be formed on the junction surface to leak wind, and therefore a packing or other part must be used. When inserting the ventilation fan main body 101 into the opening 114 while fitting into the adapter 105, to prevent the flat portion 108 from hitting against the opening 114 of the ceiling 113 to make it hard to insert, the wall 109 is provided to form the ventilation fan main body 101 in a box shape, which causes to increase the material cost.

SUMMARY OF THE INVENTION

The ventilation fan for duct in accordance with an exemplary embodiment of the present invention comprises:

(a) a blower including a fan installed inside, an intake port formed at the lower side, and a scroll having an exhaust port, and (b) a wind tunnel installed in the intake port, and having a curved portion rotatable along the brim of an opening formed in a ceiling, and therefore as the curved portion of the wind tunnel rotates along the brim of the opening, the blower and the wind tunnel are fitted to the ceiling.

A ventilation fan for duct in accordance with a further exemplary embodiment of the present invention further comprises an adapter for duct connection detachably fitted to the exhaust port.

A ventilation fan for duct in accordance with a further exemplary embodiment of the present invention further comprises a decorative plate which can be installed by covering the lower surface of the wind tunnel.

A ventilation fan for duct in accordance with a further exemplary embodiment of the present invention further comprises a taper rib formed on the outer circumference of the scroll, and expanding from upper to lower direction.

A method of installation of ventilation fan in accordance with an exemplary embodiment of the present invention comprises:

(a) a step of inserting a ventilation fan main body having a blower including an exhaust port formed in the side and an intake port formed in the lower surface, and a wind tunnel installed in the lower surface of the intake port, while rotating along the brim of a circular opening formed in a ceiling, and (b) a step of fitting a curved portion installed in the lower circumference of the wind tunnel of the ventilation fan main body inserted in the ceiling, into the circular opening in the ceiling, and fixing the ventilation fan main body in the ceiling.

A method of installation of ventilation fan in accordance with an exemplary embodiment of the present invention further comprises:

(c) a step of installing a decorative plate by covering the lower surface of the wind tunnel of the ventilation fan main body fixed in the ceiling.

A method of installation of ventilation fan in accordance with an exemplary embodiment of the present invention further comprises:

(c) a step of connecting the ventilation fan main body and an adapter for exhaust duct connection, so that a curved shape bump installed at the outer side of the intake port may be fitted to a receiving portion of the adapter preliminarily installed in the ceiling when the ventilation fan main body is inserted into the ceiling.

In a method of installation of ventilation fan in accordance with an exemplary embodiment of the present invention, a taper rib expanding from upper to lower direction is formed on the outer circumference of the ventilation fan main body, and the ventilation fan main body is installed in the ceiling by inserting into the opening of the ceiling along the rib.

In a preferred embodiment, the opening of the ceiling has a circular form.

In a preferred embodiment, the opening of the ceiling has a circular form, and the wind tunnel has a cylindrical form to be inserted into the opening.

In a preferred embodiment, the wind tunnel has a shape larger than the scroll.

In a preferred embodiment, the exhaust port is formed in the side of the blower.

In a preferred embodiment, the decorative plate is supported rotatably in the wind tunnel.

In a preferred embodiment, the fan is a centrifugal fan.

In a preferred embodiment, the curved portion has a flange installed on the lower periphery of the wind tunnel.

According to an exemplary embodiment of the present invention, the ventilation fan can be smoothly inserted into the opening in the ceiling.

Further, the ventilation fan for duct free from strange feel between the design of the decorative plate and the pattern of the ceiling can be presented.

Moreover, without using packing or other part, the exhaust port formed in the side of the blower and the adapter for connecting the exhaust duct can be directly connected tightly, and therefore the connection work of the exhaust duct and the export port of the blower is easy, and the use of packing material is saved, and the material cost is lowered.

DETAILED DESCRIPTION OF THE INVENTION

Embodiments of the invention are described below while referring to FIG. 1 through FIG. 3.

Embodiment 1

Figure 1:
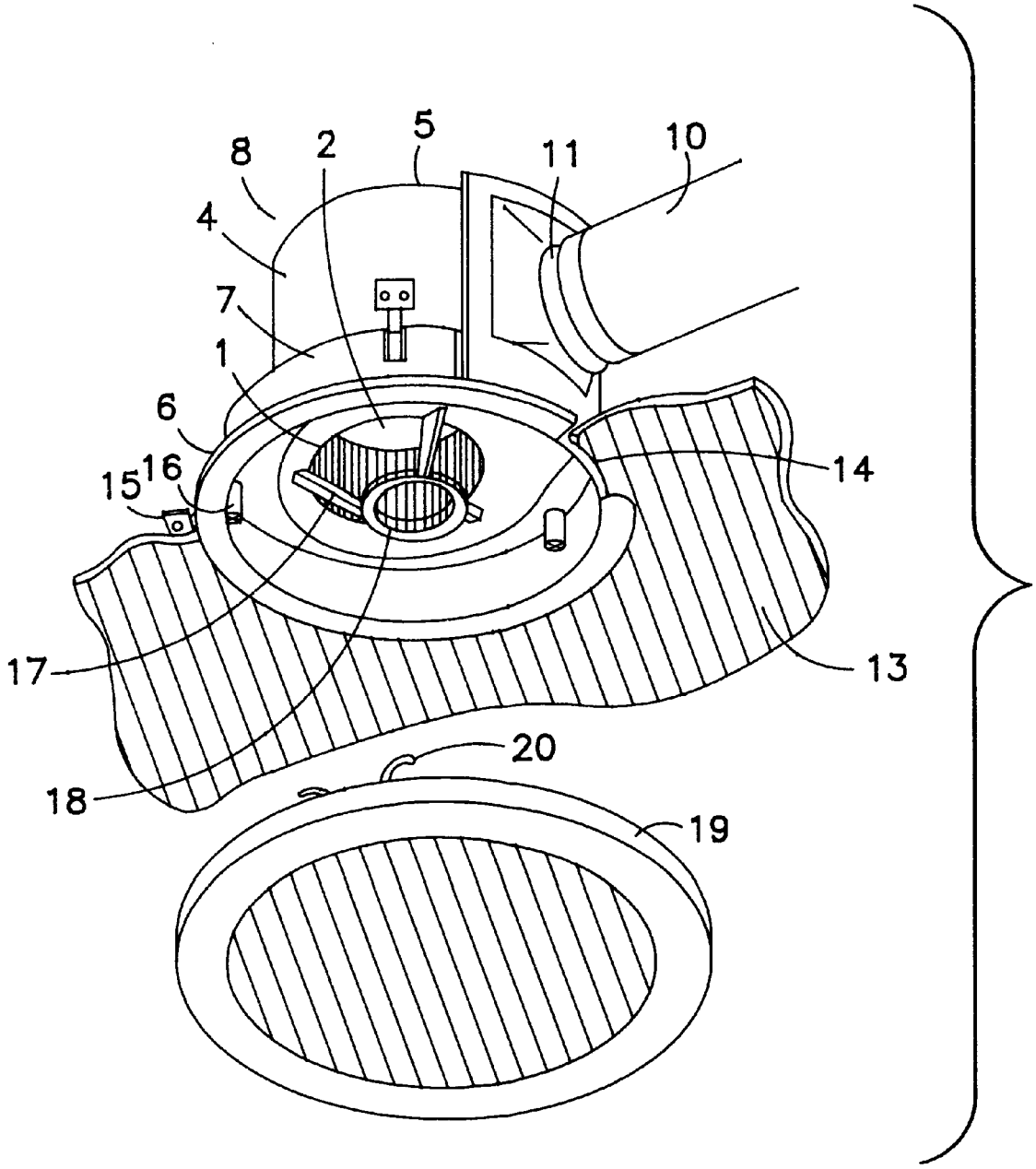
FIG. 1 is a perspective view showing a state of installation of ventilation fan for duct in embodiment 1 of the invention.

A perspective view showing the state of installation of ventilation fan for duct in embodiment 1 of the invention is shown in FIG. 1, and a longitudinal sectional view of connecting the ventilation fan in the adapter is given in Fig .2.

Figure 2:
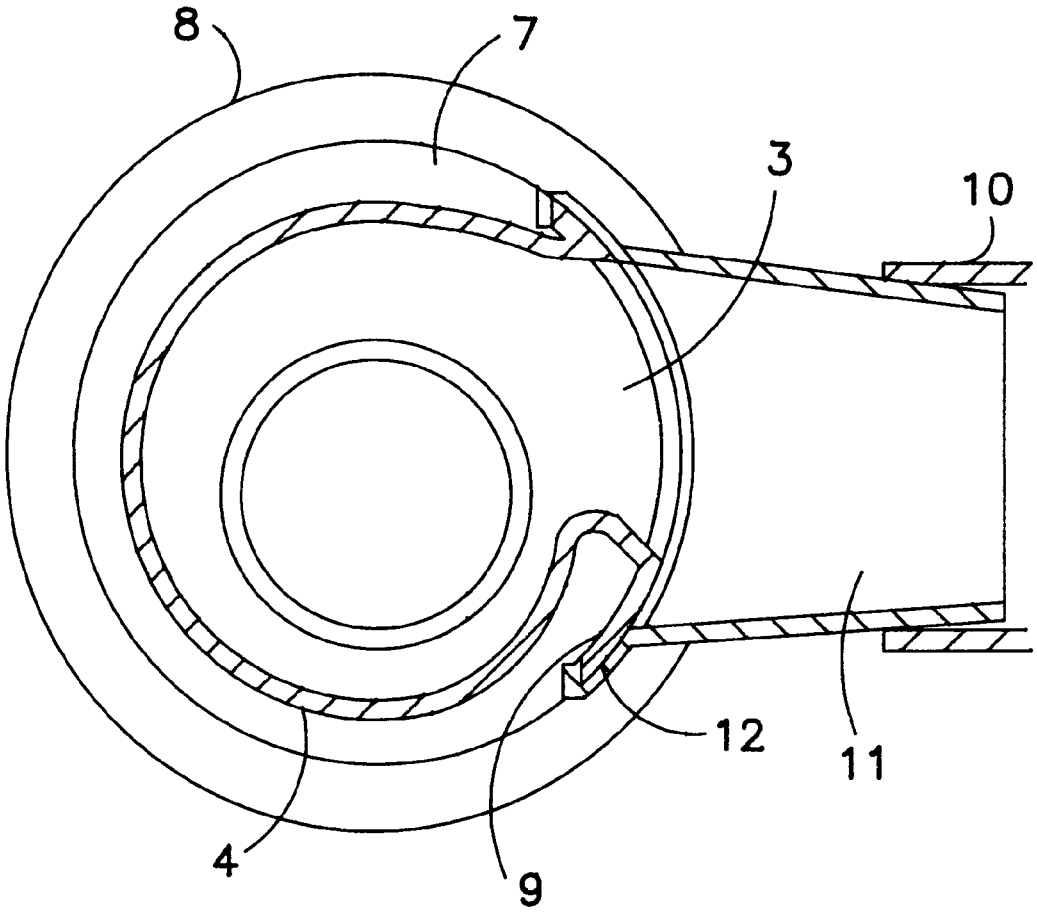
FIG. 2 is a longitudinal sectional view showing a state of connection of the ventilation fan for duct in embodiment 1 of the invention into an adapter.

In FIG. 1 and FIG. 2, a blower 5 has a cylindrical housing, and this blower comprises a centrifugal fan 1 driven by a motor (not shown) installed in the housing, an intake port 2 formed in the lower surface, and a scroll 4 having an exhaust port 3 formed in the side. A ventilation fan main body 8 has a blower 5 and a wind tunnel 7 installed at the lower end of the intake port 2 side of the blower 5. The wind tunnel 7 has a cylindrical shape having a larger shape than the scroll 4. The wind tunnel 7 has a curved portion installed at its lower portion. Its curved portion has a flange 6 projecting outward around the lower periphery of the wind tunnel 7.

The exhaust port 3 of the ventilation fan main body 8 has a curved shape conforming to the housing of the blower. A curved shape bump 9 is set on the outer surface of the housing around the exhaust port 3. An exhaust duct 10 communicating outdoors is preliminarily installed in a ceiling 13, and an adapter 11 is connected to this exhaust duct 10. The adapter 11 has a structure detachable in the exhaust port 3. The adapter 11 has a curved shape conforming to the shape of the housing around the exhaust port 3. A receiving portion 12 is formed on the surface of the adapter 11. It is constituted so that the bump 9 formed on the ventilation fan main body 8 may be engaged with the receiving portion 12 formed in the adapter 11. That is, the receiving portion 12 is engaged with the bump 9 so as to be freely slidable vertically.

An opening for mounting 14 is formed in the ceiling 13. The ventilation fan main body 8 having the blower 5 and wind tunnel 7 is inserted into the ceiling 13 through the opening 14, and the peripheral edge of the opening for mounting 14 is held by a flange 6, and plural fixing brackets 15 for fixing the ventilation fan main body 8 are designed to be tightened as being drawn back by rotation of a screw 16. An annular spring holder 18 is disposed at the lower surface of the scroll 4, being supported in the center of the wind tunnel 7 by plural support legs 17. Moreover, a cylindrical decorative plate 19 is installed so as to cover the lower surface of the wind tunnel 7. A bifurcate spring 20 is installed on the upper surface of the circular decorative plate 19, and this bifurcate spring 20 has a releasing width having an elastic force to open and close freely. The spring 20 is inserted into the holder 18, and is held by the spring holder 18. Thus, the decorative plate 19 is rotatably supported in the ventilation fan main body 8 having the blower 5 and wind tunnel 7.

In this constitution, when installing the ventilation fan for duct, the exhaust duct 10 is preliminarily installed at the position for installing the ventilation fan for duct. Moreover, the opening for mounting 14 for inserting the ventilation fan main body 8 is formed in the ceiling 13. In this state, first the adapter 11 is inserted into the opening for mounting 14, and this adapter 11 is fixed in the exhaust duct 19 by tape or the like.

Consequently, so as to move upward along the adapter 11, the ventilation fan main body 8 is inserted into the opening for mounting 14 in the ceiling 13. At this time, the curved shape bump 9 formed in the exhaust port 3 of the ventilation fan main body 8 is engaged with the curved shape receiving portion 12 provided in the adapter 11, and the exhaust port 3 of the ventilation fan main body 8 is connected to the adapter 11. Then, moving the fixing bracket 15 by manipulation of the screw 16, and the peripheral edge of the opening for mounting 14 in the ceiling 13 is held by the flange 6 and fixing bracket 15 provided in the wind tunnel 7. In this way, the ventilation fan main body 8 having the blower 5 and wind tunnel 7 is installed in the ceiling 13.

The decorative plate 19 is fitted to the ventilation fan main body 8 installed in the ceiling 13 by covering the intake port 2. That is, the decorative plate 19 is pressed against the ventilation fan main body so as to cover the opening from the lower side, and rotates. At this time, the releasing width of the bifurcate spring 20 set n the upper surface of the decorative plate 19 is contracted by resisting the elastic force of the spring 20, and the upper portion of the spring 20 is inserted into the spring holder 18 provided in the ventilation fan main body 8. At this time, the spring 20 is held in the spring holder 18 by the elastic force in the outward opening direction of the spring 20. Thus, the decorative plate 19 is rotatably supported in the ventilation fan main body, and the decorative plate 19 is mounted on the ventilation fan main body 8.

Thus, according to the ventilation fan for duct of embodiment 1 of the invention, if the exhaust duct 10 is disposed obliquely, not conforming to the vertical or lateral line of the building, since the ventilation fan main body 8 has a circular form, the ventilation fan main body 8 is freely rotated in the opening for mounting 14, and it is easily installed so that the direction of the exhaust port 3 may be set to the direction of installation of the exhaust duct 10. That is, since the shape of the ceiling opening 14 necessary when installing the ventilation fan main body 8 is circular, the direction of installation of the ventilation fan main body is free in a range of 360 degrees, and at the same time the mounting direction of the decorative plate 19 is also free in a range of 360 degrees. Still more, sine the decorative plate 19 is rotatably supported by the ventilation fan main body 8, by rotating the decorative plate 19, the pattern of the ceiling 13 in which the ventilation fan main body 8 is installed and the design of the decorative plate 19 can be matched easily. As a result, strange feel due to the decorative plate 19 can e prevented. Moreover, since the exhaust port of the ventilation fan main body 8 and the adapter 11 are matched in the curved shape, the exhaust port 3 and adapter 11 can be connected tightly without using packing or other part.

Embodiment 2

Figure 3:
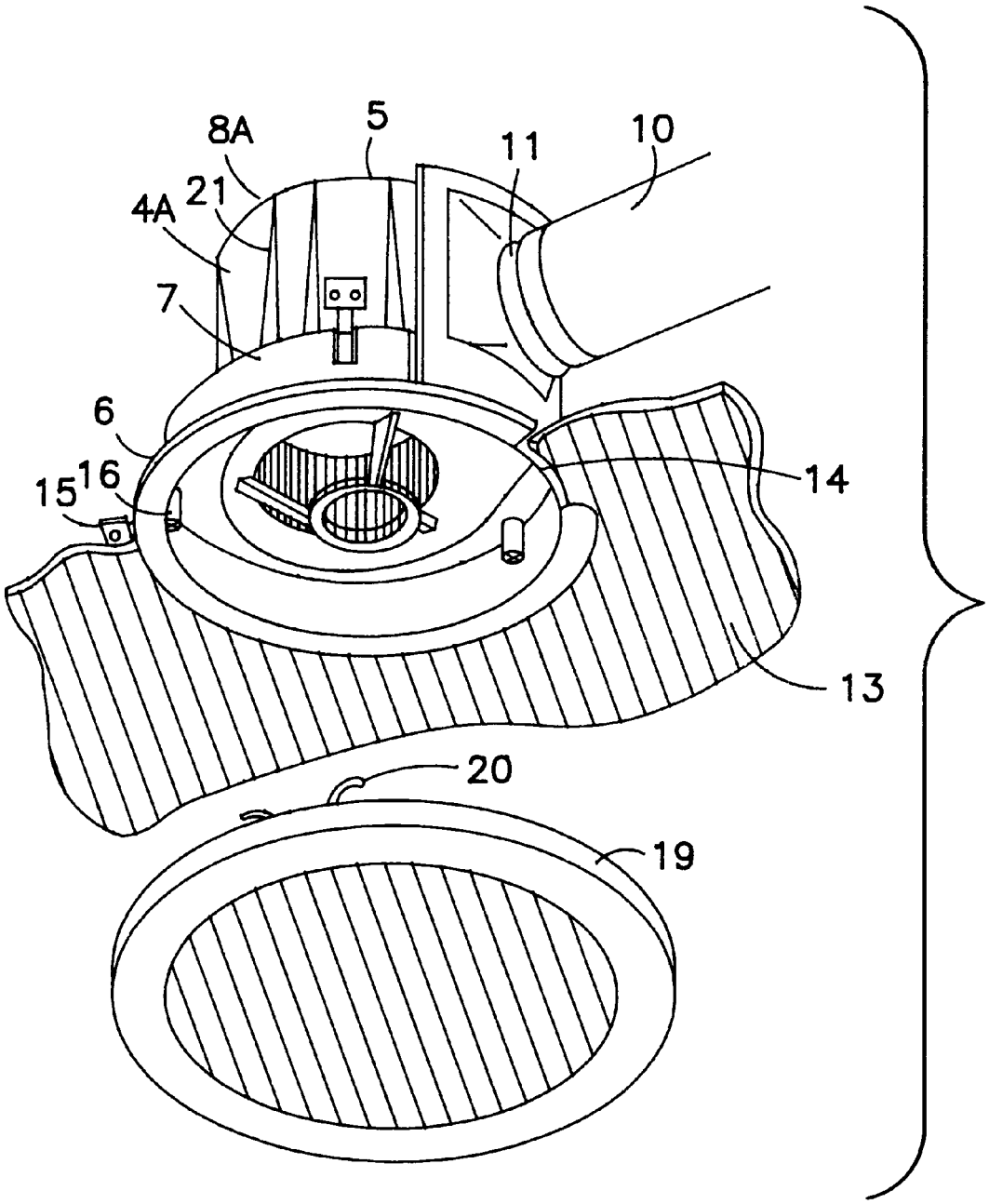
FIG. 3 is a perspective view showing a state of installation of ventilation fan for duct in embodiment 2 of the invention.
Figure 4:
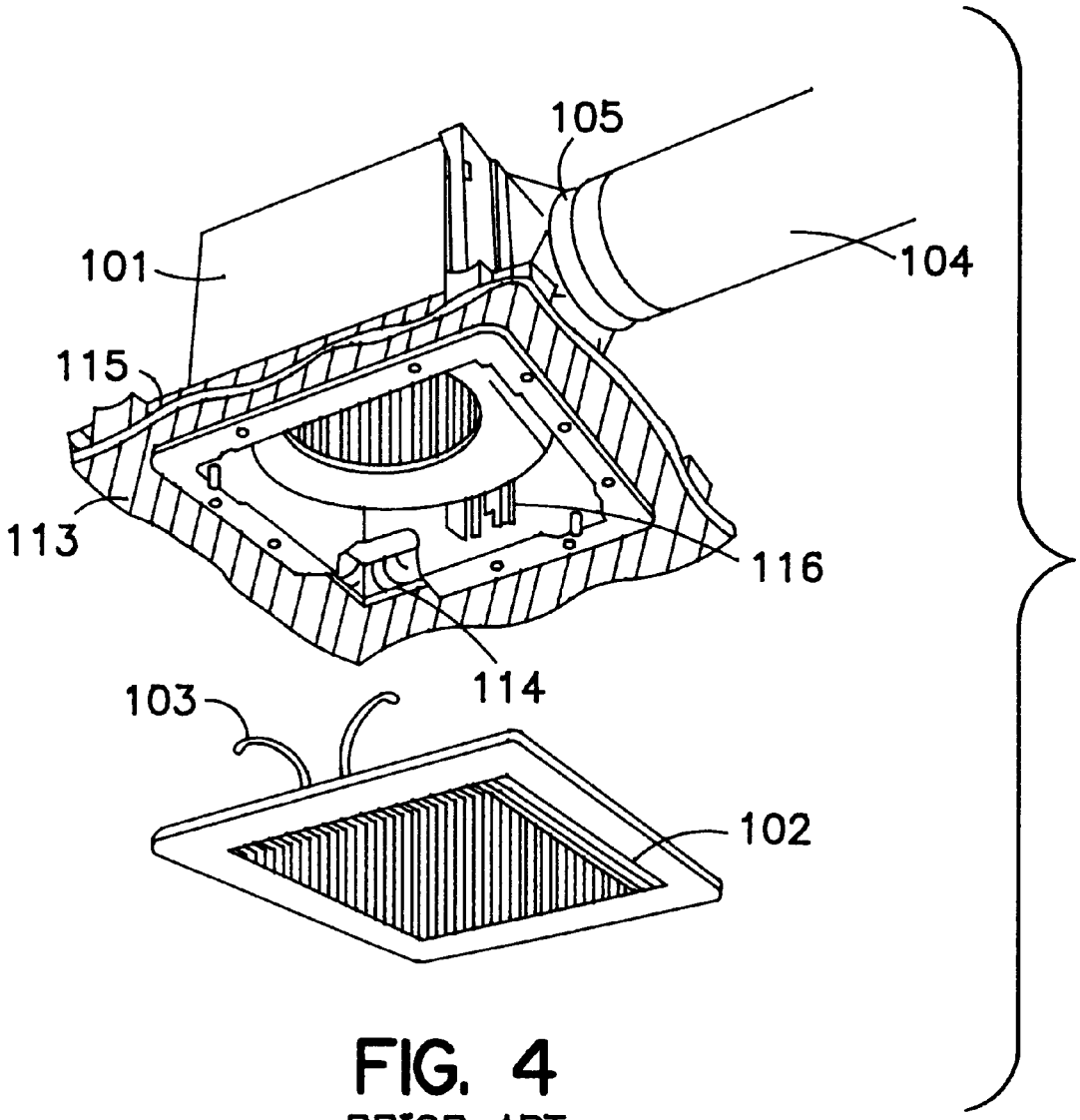
FIG. 4 PRIOR ART
FIG. 4 is a perspective view showing a state of installation of a conventional ventilation fan for duct.
Figure 5:
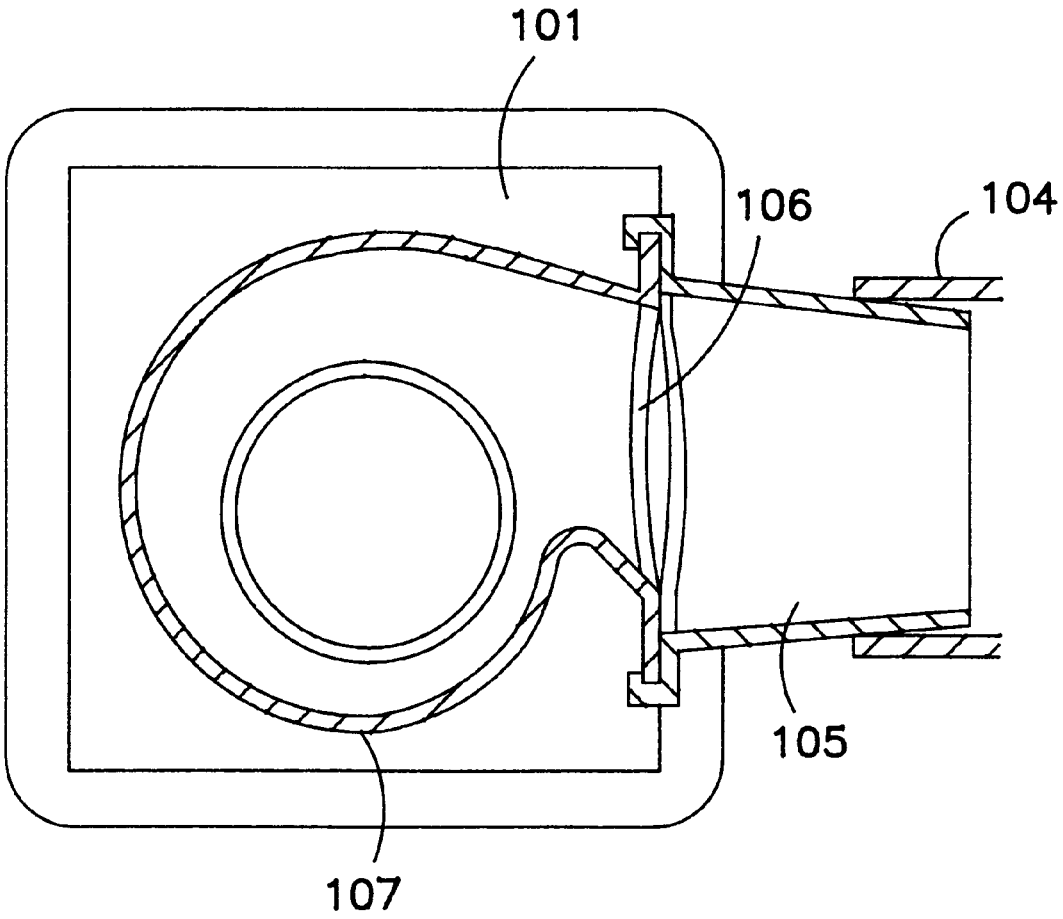
FIG. 5 PRIOR ART
FIG. 5 is a longitudinal sectional view showing a state of connection of the conventional ventilation fan for duct into an adapter.
Figure 6:
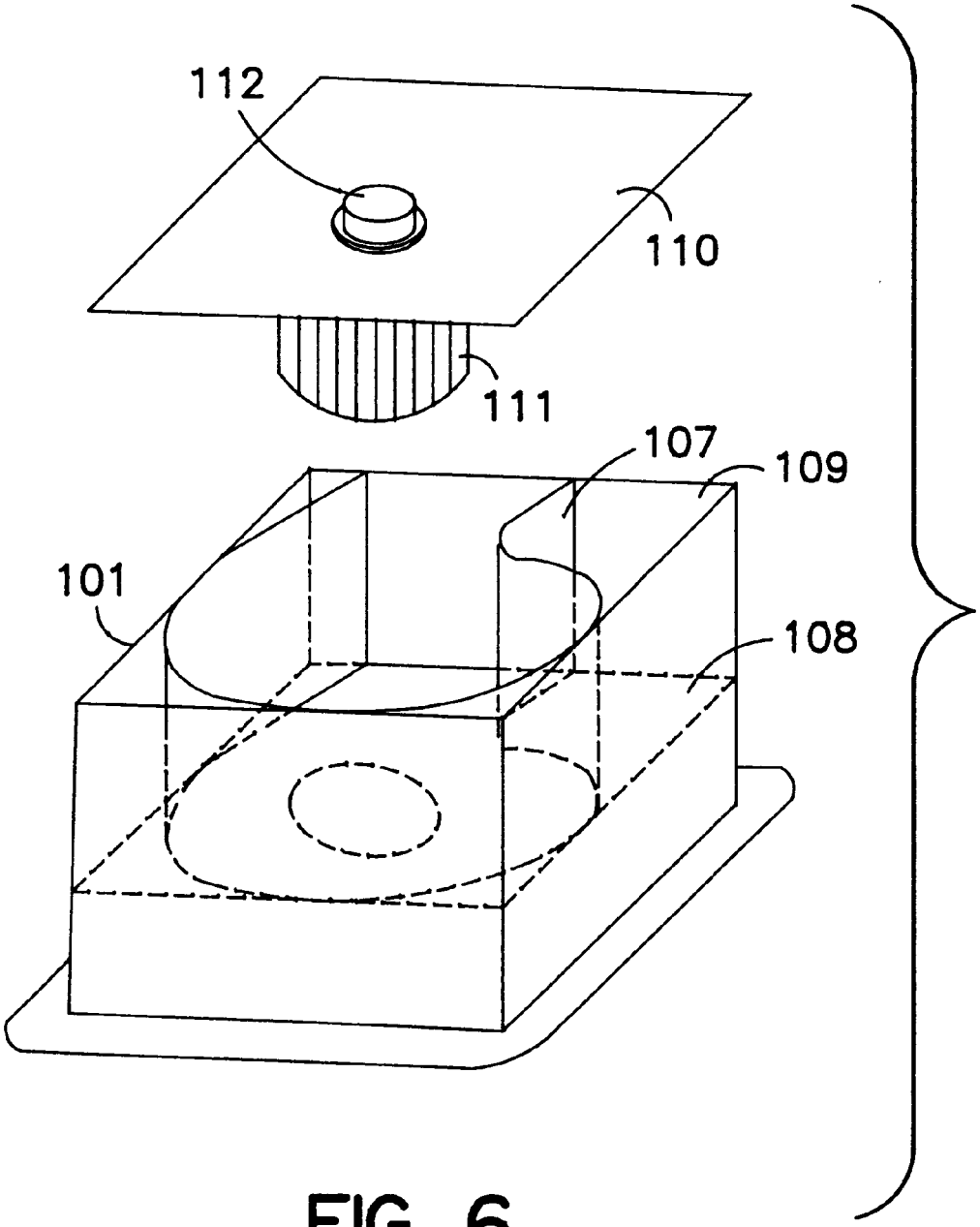
FIG. 6 PRIOR ART
FIG. 6 is a perspective exploded view showing a constitution of the conventional ventilation fan for duct.

A perspective view showing a state of installation of a ventilation fan for duct in embodiment 2 of the invention is shown in FIG. 3. As shown in FIG. 3, a ventilation fan main body 8A has plural taper ribs 21 expanding toward s wind tunnel 7 formed so as to enclose a scroll 4A on the outer circumference of the scroll 4A of a blower 5. In this constitution, when installing a ventilation fan for duct, the ventilation fan main body 8A is inserted into an opening for mounting 14 provided in a ceiling 13 so as to connect an exhaust port (not show) of the ventilation fan main body 8A to an adapter 11 connected to an exhaust duct 10. At this time, by the taper ribs 21 formed in the scroll 4A of the ventilation fan main body 8A, the ventilation fan main body 8A is guided, inserted and placed in the opening for mounting 14. The other constitution is same as in embodiment 1.

According to the ventilation fan for duct in embodiment 2 of the invention, the taper ribs 21 provided in the scroll 4A can play the role of guide for inserting the ventilation fan main body 8A into the opening for mounting 14 provided in the ceiling 13, so that the ventilation fan main body 8A can be inserted smoothly into the opening for mounting 14.

As clear from the embodiments, according to the invention, the ventilation fan can be smoothly inserting into the opening in the ceiling. Moreover, the ventilation fan for duct free from strange feel between the design of the decorative plate and pattern of the ceiling can be presented. Also, without using packing or other part, the ventilation fan for duct capable of fitting tightly the exhaust port in the side of the ventilation fan main body and the adapter for connecting the exhaust duct can be presented. Moreover, positioning for connecting the ventilation fan main body and exhaust duct is easy. Furthermore, without using packing or other pat, the ventilation fan for duct capable of saving the material cost can be presented.

What is claimed is:

1. A ventilation fan for duct comprising:

(a) a ventilation fan main body having (1) a blower including a fan installed inside, an intake port formed at the lower side, and a scroll having an exhaust port, and (2) a wind tunnel installed at said intake port side of said blower, and having a curved portion rotatable along the brim of an opening formed in a ceiling, (b) an adapter for duct connection detachably fitted to said exhaust port, and (c) a decorative plate which may be installed by covering the lower surface of said wind tunnel, whereby as said curved portion of said wind tunnel rotates along said brim of said opening, said ventilation fan main body is fitted to said ceiling, and said decorative plate is fitted to the lower side by covering said wind tunnel.

2. A ventilation fan for duct of claim 1, wherein said opening of said ceiling has a circular form.

3. A ventilation fan for duct of claim 1, wherein said exhaust port is formed at the side of said blower.

4. A ventilation fan for duct of claim 1, wherein said wind tunnel has a shape larger than said scroll.

5. A ventilation fan for duct of claim 1, wherein said fan is a centrifugal fan.

6. A ventilation fan for duct of claim 1, wherein said opening of said ceiling has a circular form, and said wind tunnel has a cylindrical form to may be inserted into said opening.

7. A ventilation fan for duct of claim 1, wherein said decorative plate is rotatably supported in said wind tunnel.

8. A ventilation fan for duct of claim 1, wherein said opening of said ceiling has a circular form, said wind tunnel has a cylindrical form to may be inserted into said opening, and said decorative plate is rotatably supported in said wind tunnel.

9. A ventilation fan for duct of claim 1, wherein said decorative plate has a circular form.

10. A ventilation fan for duct of claim 1, wherein said opening of said ceiling has a circular form, said wind tunnel has a cylindrical form to may be inserted into said opening, said wind tunnel may be installed in said ceiling through said opening, said decorative plate has a circular form, and said decorative plate is rotatably supported in said wind tunnel.

11. A ventilation fan for duct of claim 1, wherein said exhaust port is formed in the side of said scroll, said exhausts port has a curved shape, said exhaust port has a curved shape bump installed at its outside, said adapter has a curved shape receiving portion, and said bump is engaged with said receiving portion so that said exhaust port is connected to said adapter.

12. A ventilation fan for duct of claim 1, wherein said exhaust port is formed in the side of said scroll, said opening of said ceiling has a circular form, said wind tunnel has a cylindrical form to may be inserted into said opening, said wind tunnel is fitted into said opening, said decorative plate has a circular form, said decorative plate is rotatably supported in said wind tunnel, said exhausts port has a curved shape, said exhaust port has a curved shape bump installed at its outside, said adapter has a curved shape receiving portion, and said bump is engaged with said receiving portion so that said exhaust port is connected to said adapter.

13. A ventilation fan for duct comprising:

(a) a ventilation fan main body having (1) a blower including a fan installed inside, an intake port formed at the lower side, and a scroll having an exhaust port, and (2) a wind tunnel installed at said intake port side of said blower, and having a curved portion rotatable along the brim of an opening formed in a ceiling, (b) an adapter for duct connection detachably fitted to said exhaust port, (c) a decorative plate which can be installed by covering the lower surface of said wind tunnel, and (d) a taper rib formed on the outer circumference of said scroll, and expanding from upper to lower direction, whereby as said curved portion of said wind tunnel rotates along said brim of said opening, said ventilation fan main body is fitted to said ceiling, said decorative plate is fitted to the lower side covering said wind tunnel, and said ventilation fan main body is installed in said ceiling by inserting into said opening in said ceiling along said rib.

14. A ventilation fan for duct of claim 13, wherein said opening of said ceiling has a circular form, and said wind tunnel has a cylindrical form to may be inserted into said opening.

15. A ventilation fan for duct of claim 13, wherein said opening of said ceiling has a circular form, said wind tunnel has a cylindrical form to may be inserted into said opening, said decorative plate has a circular form, and said decorative plate is rotatably supported in said wind tunnel.

16. A ventilation fan for duct comprising:

(a) a blower including a fan installed inside, an intake port formed at the lower side, and a scroll having an exhaust port, (b) a wind tunnel installed at said intake port side of said blower, and having a curved portion rotatable along the brim of an opening formed in a ceiling, and (c) a decorative plate which may be installed by covering the lower side of said wind tunnel, whereby as said curved portion of said wind tunnel rotates along said brim of said opening, said blower and said wind tunnel are fitted to said ceiling, and said decorative plate is fitted to the lower side by covering said wind tunnel.

17. A ventilation fan for duct of claim 16, wherein said opening of said ceiling has a circular form, said wind tunnel has a cylindrical form to may be inserted into said opening, said decorative plate has a circular form, and said decorative plate is rotatably supported in said wind tunnel.

18. A ventilation fan for duct of claim 16, wherein said curved portion has a flange installed in the periphery of the lower end of said wind tunnel, said flange rotates about said brim of said opening to fit said wind tunnel to said ceiling, and said decorative plate is installed at the lower side of said wind tunnel by covering said flange fitted to said ceiling.

19. A method of installation of a ventilation fan for a duct, comprising the steps of:

(a) inserting a ventilation fan main body comprising a blower including an exhaust port formed in the side and an intake port formed in the lower surface, and a wind tunnel installed in the lower surface of said intake port, while rotating along the brim of a circular opening formed in a ceiling, (b) fitting a curved portion installed in the lower circumference of said wind tunnel of said ventilation fan main body inserted in said ceiling, into said circular opening in said ceiling, and fixing said ventilation fan main body in said ceiling, and (c) installing a decorative plate by covering the lower surface of said wind tunnel of said ventilation fan main body fixed in said ceiling.

20. A method of installing a ventilation fan for a duct, comprising the steps of:

(a) inserting a ventilation fan main body comprising a blower including an exhaust port formed in the side and an intake port formed in the lower surface, and a wind tunnel installed in the lower surface of said intake port, while rotating along the brim of a circular opening formed in a ceiling, and (b) fitting a curved portion installed in the lower circumference of said wind tunnel of said ventilation fan main body inserted in said ceiling, into said circular opening in said ceiling, and fixing said ventilation fan main body in said ceiling, wherein a taper rib expanding from upper to lower direction is formed on the outer circumference of said ventilation fan main body, and said ventilation fan main body is installed in said ceiling by inserting into said opening of said ceiling along said rib.

* * * * *